US005355430A

United States Patent [19]

Huff

[11] Patent Number: 5,355,430

[45] Date of Patent: Oct. 11, 1994

[54] METHOD FOR ENCODING AND DECODING A HUMAN SPEECH SIGNAL BY USING A SET OF PARAMETERS

[75] Inventor: Russel D. Huff, Grand Junction, Colo.

[73] Assignee: Mechatronics Holding AG, Vaduz, Liechtenstein

[21] Appl. No.: 743,843

[22] Filed: Aug. 12, 1991

[51] Int. Cl.[5] ..... G10L 9/00

[52] U.S. Cl. ..... 395/2.32

[58] Field of Search ..... 381/29–45; 395/2.32

[56] References Cited

U.S. PATENT DOCUMENTS

| | | | |
|---|---|---|---|
| 4,382,160 | 5/1983 | Gosling et al. | 381/31 |
| 4,916,742 | 4/1990 | Koslensnikov et al. | 381/31 |
| 5,008,940 | 4/1991 | Blum | 381/31 |
| 5,091,949 | 2/1992 | King | 381/43 |

*Primary Examiner*—Michael R. Fleming

*Assistant Examiner*—Michelle Doerrler

*Attorney, Agent, or Firm*—Ward & Olivo

[57] ABSTRACT

The present invention discloses a method for encoding and decoding human speech signals by generating a data base which stores a number of human speech signal types. The number of human speech signal types stored is sufficiently high enough to cover substantially all observable human speech. According to a first embodiment of the invention, a set of representative human speech signal curves is taken directly from natural human speech. According to a second embodiment of the invention, a predetermined set of speech signal parameters is used where maximum voice signal segment values are measured. According to a third embodiment of the invention, an adaptive set of speech signal parameters is used, where the encoder transmits a set of signal parameters to the decoder. Although the invention is specifically designed for human speech, it can also be used in connection with other audio signals, such as those of electronic musical instruments.

18 Claims, 4 Drawing Sheets

METHOD FOR ENCODING AND DECODING A HUMAN SPEECH SIGNAL BY USING A SET OF PARAMETERS

SUMMARY OF THE INVENTION

The present invention relates to a method of encoding and decoding a human speech signal.

Today, for many applications it is highly desired to process speech signals by digital computer-based methods. This is especially true, e.g. for telephone applications. A typical telephone-quality speech signal is band pass filtered between 200 Hz and 3,4 Khz. If this signal is sampled at 8000 samples per second and encoded by pulse code modulation of 8 bit resolution, a data rate of approximately 64 kBit/s would have to be processed. Hence, the objectives of most telephone speech signal compression techniques are:

1) Generate a compressed encoded representation of the original signal that requires much fewer than those 64 kbit/s.
2) Reconstruct the original signal from the compressed encoded representation by a decoding procedure minimizing the degradation of the original signal.

It has been observed that a representation of a speech waveform that plays only a digital pulse or "spike" to an electronic speaker at the same instant in time that the original signal exhibits a local maximum will contain a considerable part of the information content of the original speech waveform. A person listening to that "spike train" can tell what was said, the inflection of the speech, and generally, who was speaking, although the representation of the original waveform is inherently extremely noisy. The original speech waveform is thus the result of the human vocal apparatus creating an acoustic signal that reproduces the underlying sequence of intervals between local maxima. Hence, although the information content of a human speech waveform has been encoded to some extent by specifying the intervals between said spikes in the above-mentioned observation, in the context of technical applications requiring an acceptable level of noise-to-signal ratio, additional features of the signal must also be encoded.

From U.S. Pat. No. 4,382,160, methods for encoding and constructing signals have come to be known, by which a speech waveform is encoded to reduce storage capacity or transmission bandwidth. For each waveform, two features are encoded, for example (a) the duration of a sub-division, and (b) shape of the waveform within that sub-division. A first signal related to the duration of each sub-division and a second signal related to the associated shape data constitutes a pair of primary-code symbols. Decoding of the primary-code symbols provides speech synthesis by generating an analog speech signal having sub-divisions of durations determined by the first signals and a shape determined by the second signals.

A sub-division of a speech waveform, as employed in the above-mentioned U.S. Pat. No. 4,382,160, may be defined in any systematic way as long as the alternating component of the speech waveform does not cross through zero more than three times in any sub-division. Sub-divisions may extend for multiples or fractions of half-cycles. In a preferred embodiment of the above-mentioned U.S. Pat. No. 4,382,160, each sub-division extends between adjacent zero crossings, that is, a single half-cycle, however, it is also disclosed that sub-divisions may be defined with respect to predetermined maxima and minima, e.g. those immediately following a zero crossing.

The referenced document U.S. Pat. No. 4,382,160 discloses that the waveform of each sub-division can be described by a limited number of said second signals. Therefore, second signals are drawn from a limited predetermined set. Each first signal indicating the sub-division duration is related to the duration of a half cycle and each second signal indicating sub-division shape is related to the number of events occurring in a half cycle of the signal to be encoded. In this context of U.S. Pat. No. 4,382,160, "event" means any occurrence which can be identified.

In the method as disclosed in U.S. Pat. No. 4,382,160, each pair of primary code symbols, consisting of a first signal and a second signal may be operated on by encoding it as a secondary signal, each secondary signal being selected in accordance with the primary-code symbol using a mapping table.

A method of constructing an output signal has come to be known from U.S. Pat. No. 4,382,160, comprising the steps of generating an analog signal having sub-divisions of durations related to said first signals, each sub-division having a shape related to a corresponding one of said second signals, each said second signal is a signal from a set of predetermined signals and each sub-division shape in the analog signals is from a set of predetermined shapes such as said sub-divisions being defined by any predetermined characteristic of said output signal waveform so long as said output signal alternating component does not have more than three zero crossing in any of said sub-divisions.

Methods for encoding and decoding speech signals according to the state of the art exhibit the disadvantage that the quality of the reconstructed speech deserves further enchancement. Moreover, the signal compression which can be obtained by methods according to prior art is not sensitive to the characteristics of the speech of a particular group of individual speakers utilizing such a method.

Therefore, it is an object of the present invention to provide a method for encoding and decoding a human speech signal that exhibits a high compression as well as an excellent quality of the reconstructed speech signal.

According to a first aspect of the invention, a set of representative signal curves used for composing a decoded speech signal is taken from natural human speech. This improves the fidelity of the reconstructed (decoded) speech signal.

According to a second aspect of the invention, a predetermined set of parameter variables, describing a "curvelet" (this concept will be explained below) between a first local extreme value and a second extreme value of the same category being adjacent to each other and defining the location of two adjacent spikes of said spike train, comprises the following parameter variables: a first parameter variable (d) having a value that for each curvelet equals a quantized value of the duration of said curvelet; a second parameter variable ($A_1$) having a value that for each curvelet equals a quantized value of said first extreme value of said curvelet; a third parameter variable ($A_2$) having a value that for each curvelet equals a quantized value of said second extreme value of the curvelet a fourth parameter variable ($A_3$) having a value that for each curvelet equals a quantized value of a third local extreme value of said curvelet located between said first local extreme value and said second extreme value and which is of opposite category with regard to said first and second extreme values; and a fifth parameter variable ($A_4$) having a value that for each curvelet equals a quantized value of a duration between the occurrence of said first local extreme value and the occurrence of said third local extreme value, expressed as a percent value relative to the duration of said curvelet. This also improves the fidelity of the reconstructed (decoded) speech signal and enables a high signal compression.

According to a third aspect of the invention, a curvelet data base representing a collection of typical speech patterns (for a concise explanation, see below) includes subsets which are identified to be characteristic for speech signals of single human speakers or groups of human speakers or classes of human speakers, and the process of composing a decoded speech signal is performed on a basis of representative signal curves being confined to one or more of said subsets thereof. Thereby, the method can be improved to adapt to specific characteristics of the speaker uttering the speech signal to be encoded. This aspect of the present invention leads to an enhanced signal compression.

According to a fourth aspect of the invention, the method is not limited to human speech signals. Each cohesive body of signals may be used; e.g. the sound of a piano. In this case, 'natural signal source' means e.g. a real piano or the like.

The present invention as well as advantages and further objects are now illustrated using the embodiments described below as examples.

DETAILED DESCRIPTION OF THE PREFERRED EMBODIMENT

Figure 1:
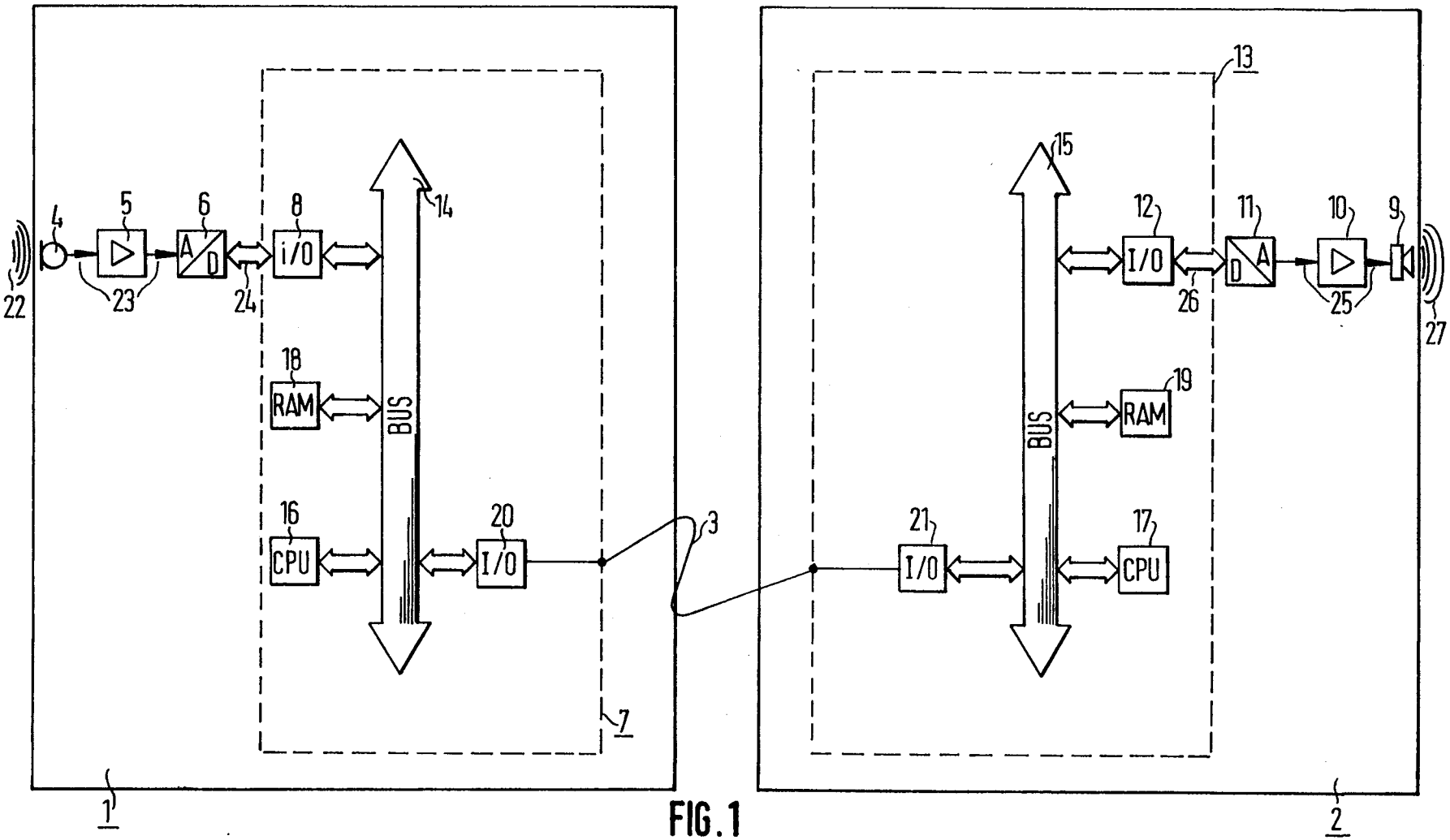
FIG. 1 shows a block circuit diagram of a digital communication system utilizing the method according to the invention.

In FIG. 1, a block circuit diagram of a digital communication system utilizing the method according to the invention is shown. The digital communication system might, for example, be utilized in the context of a telephone system. A sender unit 1 is connected with a receiver unit 2 via a link 3. The sender unit 1 comprises a microphone 4 or the like as a source for an incoming analog electrical speech signal 23, a preamplifier 5, the input terminal of said preamplifier 5 being connected to said microphone 4, an analog-to-digital converter or A/D converter 6 connected to the output terminal of said preamplifier 5 for converting the amplified incoming analog speech signal 23 supplied by said preamplifier 5 into a corresponding incoming digital speech signal 24, and a first microcomputer unit 7 having a first interface unit 8 which is adapted to read said digital signal 24 generated by said A/D converter 6.

The receiver unit 2 comprises a loudspeaker 9 or the like as a source for a reconstructed acoustical speech signal 27, an output amplifier 10, the output terminal of said output amplifier 10 being connected to said loudspeaker 9, a digital-to-analog converter or D/A converter 11 connected to the input terminal of said output amplifier 10 for converting a reconstructed digital speech signal 26 supplied by a second interface unit 12 which is driven by a second microcomputer unit 13.

Each of the first and second microcomputer units 7,13 includes a system bus 14,15 for distributing data signals, address signals, and control signals among the components of the respective microcomputer unit, as there are, besides said first and second interface units 8,12, a central processing unit (CPU) 16,17, memory means 18,19, and communication channel interfaces 20,21. The communication channel interface 20 of the first microcomputer unit 7 is connected to a first end of the communication line 3 acting as a link 3 between the first and second microcomputer units 7,13. The communication channel interface 21 of the second microcomputer unit 13 is connected to a second end of the communication line 3.

It is to be noted that each of said components of said microcomputer units 7,13 is connected to the respective one of the system buses 14,15. Said first and second microcomputer units may also comprise other components not explicitly shown in FIG. 1, for example display units, keyboards and the like.

When the digital communication system as described above is operating, an incoming acoustic speech signal 22 is converted to a corresponding incoming analog electrical speech signal 23 by said microphone 4. Said incoming analog electrical signal 23 generated by said microphone 4 is then amplified by said preamplifier 5 and converted to an incoming digital speech signal 24 by said A/D converter 6 and supplied to said first microcomputer unit 7 by means of said first interface unit 8. The incoming analog electrical speech signal 23 supplied to said A/D converter 6 is periodically sampled with a sample rate satisfying SHANNON's well-known rule related to the determination of the minimum sample rate for sampling a signal having a predetermined maximum bandwidth. If, for example, speech signals in telephone quality exhibiting frequency components up to 4 kHz are to be processed, digital samples of said incoming analog speech signal 23 have to be drawn at least each 1/8000 s. The first microcomputer unit 7 processes the stream of digital samples being equidistant in time and encodes them according to the inventive method as described further below. The result of the encoding process, a stream of symbols is then communicated to the second microcomputer unit 13 via the communication channel 3, which may be e.g. a telephone line link. The second microcomputer unit 13 receives said stream of symbols and performs a decoding process on them according to the inventive method described further below. As a result of said decoding processing, a stream of reconstructed digital samples of a reconstructed digital speech signal 26 is obtained. The digital sample values 26 which are equidistant in time are then supplied to said D/A converter 11 via said second interface unit 12. Thus, said D/A converter 11 supplies a reconstructed analog speech signal 25 from said reconstructed digital speech signal 26. Finally, the reconstructed analog speech signal 25 is made audible by means of said output amplifier 10 and said loudspeaker 9.

Figure 2:
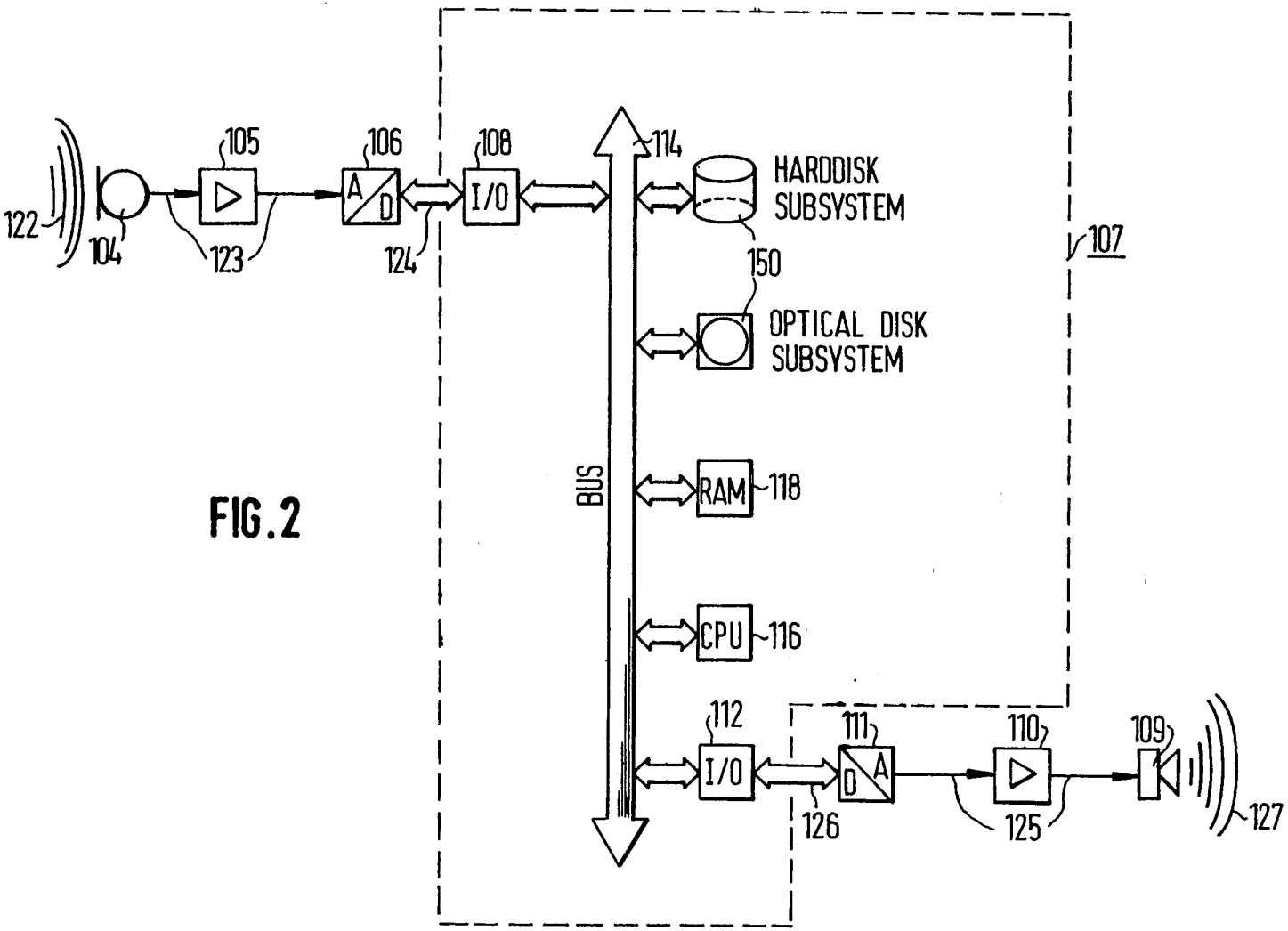
FIG. 2 shows a block circuit diagram of a digital speech storage and retrieval system utilizing the method according to the invention.

In FIG. 2, a block circuit diagram of a digital speech storage and retrieval system utilizing the method according to the invention and which might, e.g. be used within a cockpit voice recorder of an airplane is shown. The digital speech storage and retrieval system comprises a microphone 104 or the like as a source for an incoming electrical speech signal 123, a preamplifier 105, the input terminal of said preamplifier 105 being connected to said microphone 104, an analog-to-digital converter or A/D converter 106 connected to the output terminal of said preamplifier 105 for converting the incoming analog speech signal 123 of said preamplifier 105 into a corresponding incoming digital speech signal 124, and a microcomputer unit 107 having a first interface unit 108 which is adapted to read said incoming digital speech signal 124 generated by said A/D converter 106, and a second interface unit 112 which is adapted to supply a reconstructed digital speech signal to a digital-to-analog- converter or D/A converter 111 which feeds a corresponding reconstructed analog speech signal 125 to the input terminal of an output amplifier 110, the output terminal of which is connected to a loudspeaker 109 or the like.

The microcomputer unit 107 includes a system bus 114 for distributing data signals, address signals, and control signals among the components of said microcomputer unit 107, as there are a central processing unit (CPU) 116, memory means 118, and mass storage means 150.

It is to be noted that each of said components of said microcomputer unit 107 is connected to the system bus 114. Said microcomputer unit may also comprise other components not explicitly shown in FIG. 2, for example display units, keyboards and the like.

When the digital speech storage and retrieval system as described above is operating, an incoming acoustic speech signal 122 is converted to a corresponding incoming analog electrical speech signal 123 by said microphone 104. Said incoming analog electrical signal 123 generated by said microphone 104 is then amplified by said preamplifier 105 and converted to an incoming digital speech signal 124 by said A/D converter 106 and supplied to said first microcomputer unit 107 by means of said first interface unit 108. The incoming analog electrical speech signal 123 supplied to said A/D converter 106 is periodically sampled with a sample rate satisfying SHANNON's well-known rule related to the determination of the minimum sample rate for sampling a signal having a predetermined maximum bandwidth. If, for example, speech signals in telephone quality exhibiting frequency components up to 4 kHz are to be processed, digital samples of said incoming analog speech signal 123 have to be drawn at least each 1/8000 s. The microcomputer unit 107 processes the stream of digital samples being equidistant in time and encodes them according to the inventive method as described further below. The result of the encoding process, a stream of symbols, is then written to said mass storage means 150, which may be e.g. an optical or magnetical disk. When the stored encoded speech signals are to be retrieved, decoded and reproduced, said microcomputer unit 107 reads from said mass storage means 150 and performs a decoding process on the stored symbol stream according to the inventive method described further below. As a result of said decoding processing, a stream of reconstructed digital samples of a reconstructed digital speech signal 126 is obtained. The digital sample values 126 which are equidistant in time are then supplied to said D/A converter ill via said second interface unit 112. Thus, said D/A converter 111 supplies a reconstructed analog speech signal 125 from said reconstructed digital speech signal 126. Finally, the reconstructed analog speech signal 125 is made audible by means of said output amplifier 110 and said loudspeaker 109.

The method for encoding and decoding a human speech signal according to the invention to be performed by the apparatuses depicted in FIGS. 1–2 will now be explained with reference to FIGS. 3–4.

The method for encoding and decoding speech signals starts with a first step (S1) of generating a curvelet data base storing data related to a finite number of curvelet types of first human speech signals sufficient to cover substantially all observable human speech signal curvelets. A "curvelet" is an entity representing a piece of said first human speech signals on an interval of said speech signals, said curvelet being described by discrete parameter values for each parameter variable of a predetermined set of one or more parameter variables. A curvelet type is a class of curvelets described by identical parameter values. For speech encoding purposes, a unique symbol is assigned to each of said curvelet types of said curvelet data base. Said first step (S1) is typically performed using a very long speech signal consisting of a sufficiently large number of sections each representing speech of a single human speaker. Preferably, the first speech signal is taken from a large sampling of speech known as the TIMIT SPEECH DATA BASE compiled by M.I.T. and recorded by T.I. for DARPA.

Said predetermined set of parameter variables according to the invention, describing a curvelet between a first local extreme value and a second extreme value of the same category (local maximum vs. local minimum, see below) being adjacent to each other and defining the location of two adjacent spikes of said spike train, comprises preferably the following parameter variables:

- a first parameter variable (d) having a value that for each curvelet equals a quantized value of the duration of said curvelet;
- a second parameter variable ($A_1$) having a value that for each curvelet equals a quantized value of said first extreme value of said curvelet;
- a third parameter variable ($A_2$) having a value that for each curvelet equals a quantized value of said second extreme value of the curvelet;
- a fourth parameter variable ($A_3$) having a value that for each curvelet equals a quantized value of a third local extreme value of said curvelet located between said first local extreme value and said second extreme value and which is of opposite category with regard to said first and second extreme values;
- a fifth parameter variable ($A_4$) having a value that for each curvelet equals a quantized value of a duration between the occurrence of said first local extreme value and the occurrence of said third local extreme value, expressed as a percent value relative to the duration of said curvelet.

After said curvelet data base has been created, in a second step (S2) the task of encoding a second human speech signal actually to be encoded into a sequence of said symbols can be done; for this purpose, said second speech signal is sub-divided into a sequence of curvelets, each curvelet of said second speech signal being assigned to said symbol which itself is assigned to said curvelet type within said curvelet data base to which said curvelet of said second speech signal belongs, said assigned symbols forming the encoded human speech signal in the order of the curvelets within said second speech signal.

In a third step (S3), a decoded speech signal corresponding to said second human speech signal is composed as a series of chained representative signal curves taken from a set of representative signal curves in the order of the symbols of the encoded second human speech signal, each representative signal curve which is representative for said symbol exhibits a single curvelet being assigned to said symbol.

In a preferred embodiment of the present invention, said set of representative signal curves used for composing said decoded speech signal is taken from natural human speech.

Figure 3:
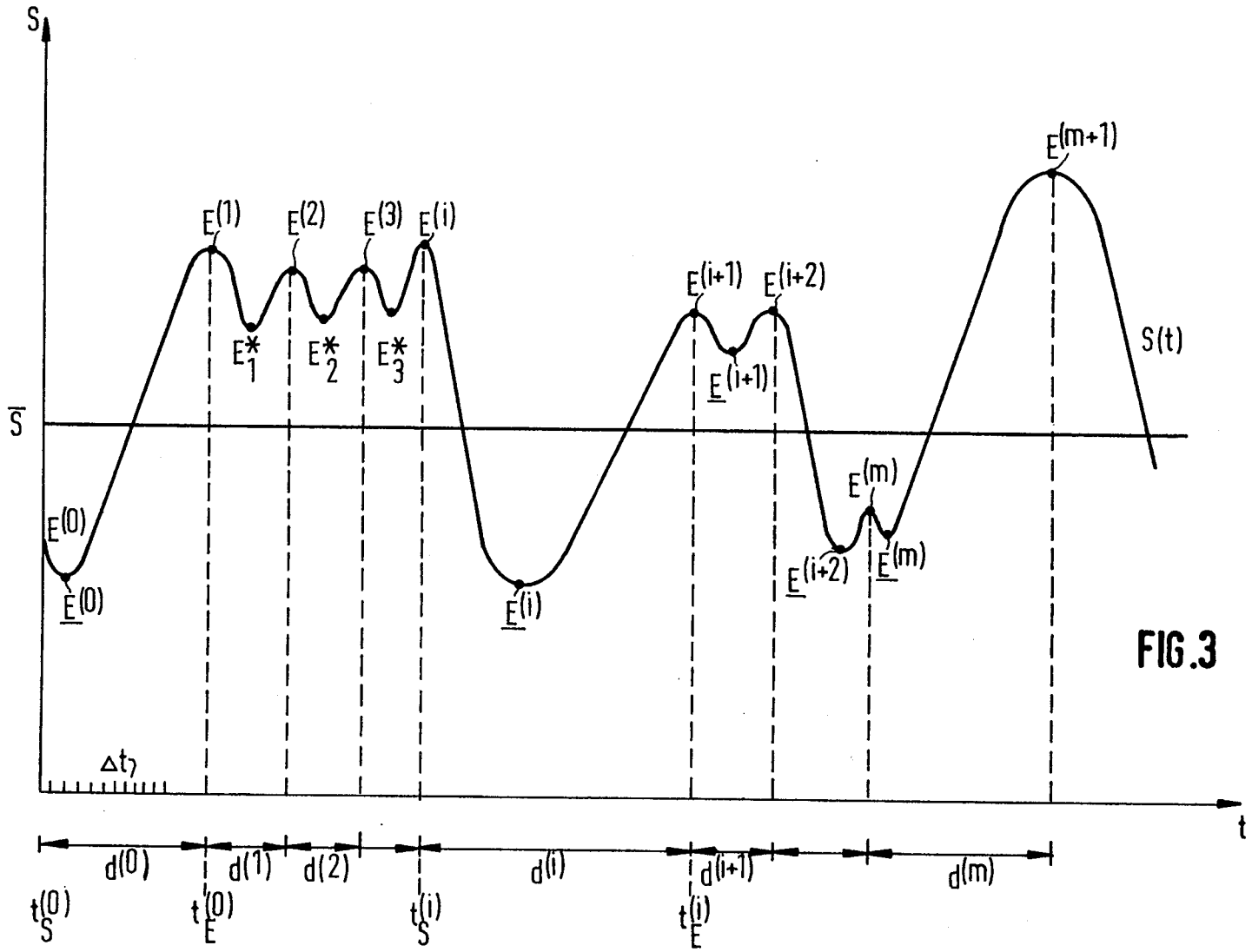
FIG. 3 shows a diagram depicting an example of a speech signal to be encoded by the method according to the invention.
Figure 4:
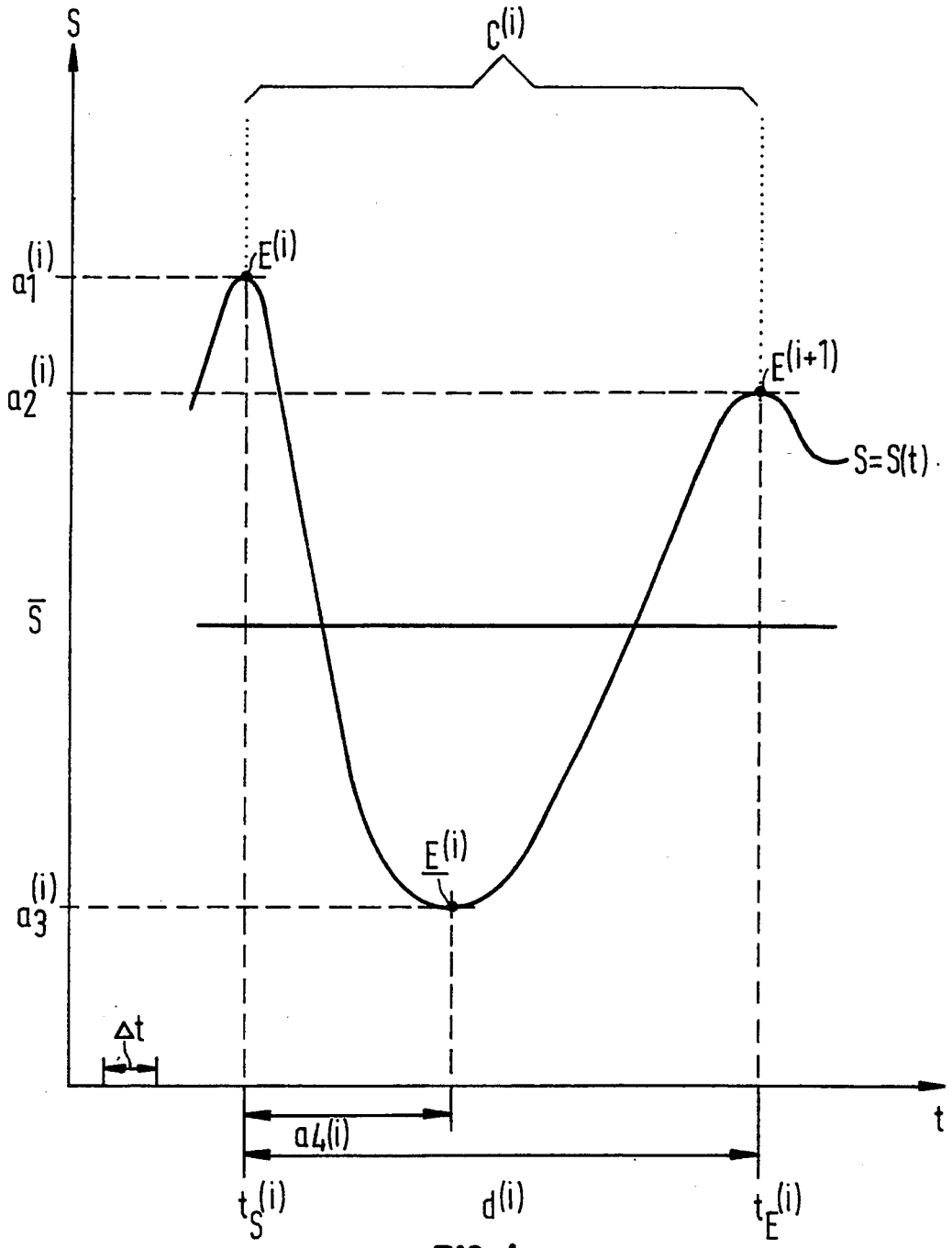
FIG. 4 shows an enlarged detail of the speech signal of FIG. 3.

FIG. 3 shows a diagram wherein an electrical speech signal voltage $S=S(t)$ is plotted against time t. Let $S(t)=\{s^{(0)}, s^{(1)}, S^{(2)}, \ldots, s^{(n)}\}$ be a sequence of digital samples obtained by digitizing a time varying analog speech signal equidistantly spaced with sampling intervals $\Delta t$. The sequence $D=\{d^{(0)}, d^{(1)}, d^{(2)}, \ldots, d^{(m)}\}$ is defined to be the sequence of intervals, e.g. between the local maxima $E^{(0)}, E^{(1)}, E^{(2)}, \ldots, E^{(m+1)}$ in the original signal S(t).

The procedure of sub-dividing speech signals into curvelets according to the invention can be illustrated with regard to FIG. 3. A time-discrete speech signal S(t) is sub-divided into a series $C^{(0)}, C^{(1)}, C^{(2)}, \ldots, C^{(i)}, \ldots, C^{(m)}$ of curvelets $C^{(i)}$ each representing the signal curve of said speech signal S(t) on a time interval between a start time $t^{(i)}_s$ and an end time $t^{(i)}_E$ of said curvelet $C^{(i)}$. Said start time $t^{(i)}_S$ of said curvelet $C^{(i)}$ is the time of occurrence of a first local extreme value $E^{(i)}$, e.g. a first local maximum value, of said speech signal S(t) and said end time $t^{(i)}_E$ of said curvelet $C^{(i)}$ is the time of occurrence of a second local extreme value $E^{(i+1)}$, e.g. a second local maximum value of said speech signal S(t), said second local extreme value $E^{(i+1)}$ being a local extreme value of the same category as said first extreme value $E^{(i)}$, i.e. if said first local extreme $E^{(i)}$ value is considered to be a local maximum then the second local extreme value $E^{(i+1)}$ will also be a local maximum, and, consequently, if said first local extreme $E^{(i)}$ value is considered to be a local minimum then the second local extreme value $E^{(1+1)}$ will also be a local minimum. Since both extreme values $E^{(i)}, E^{(i+1)}$ are considered to be adjacent, no further local extreme value of the same category will occur between said first local extreme value $E^{(i)}$ and said second local extreme value $E^{(i+1)}$. However, a third local extreme value of opposite kind $\underline{E}^{(i)}$ generally may occur between said first local extreme value $E^{(i)}$ and said second local extreme value $E^{(i+1)}$, i.e. if said first and second local extreme values $E^{(i)}, E^{(i+1)}$ are considered to be local maxima, said third local extreme value $\underline{E}^{(i)}$ will be a local minimum and vice versa.

With a view of FIG. 4, the definition of said curvelet-describing parameters d, $A_1$, $A_2$, $A_3$, and $A_4$ will be illustrated below. Said first parameter variable has values $d^{(i)}$ equaling the duration of said curvelet $C^{(i)}$. Said second parameter variable $A_1$ has a value $a^{(i)}_1$ that for each curvelet $C^{(i)}$ equals a quantized value of said first extreme value $E^{(i)}$ of the curvelet $C^{(i)}$. Said third parameter variable $A_2$ has a value $a^{(i)}_2$ that for each curvelet $C^{(i)}$ equals a quantized value of said second extreme value $E^{(i+1)}$ of the curvelet $C^{(i)}$. Said fourth parameter variable $A_3$ has a value $a^{(i)}_3$ that for each curvelet $C^{(i)}$ equals a quantized value of a third local extreme value $\underline{E}^{(i)}$ located between said first local extreme value and said second extreme value of the curvelet $C^{(i)}$ which is of opposite category compared to said first and second extreme values. Said fifth parameter variable $A_4$ has a value $a^{(i)}_4$ that for each curvelet $C^{(i)}$ equals a quantized value of a duration between the occurrence of said first local extreme value $E^{(i)}$ and the occurrence of said third local extreme value $\underline{E}^{(i)}$, expressed as a percent value relative to the duration $d^{(i)}$ of said curvelet $C^{(i)}$.

In this context, the concept of "quantization" means that a single value is associated with a range of values. For example, suppose a range of values described by the following table:

TABLE 1

| Range | Low Limit | High Limit |
|---|---|---|
| 0 | 0 | 16 |
| 1 | 16 | 32 |
| 2 | 32 | 64 |
| 3 | 64 | 96 |
| 4 | 96 | 128 |

If, for example, the number 44 is to be quantized using the quantization mapping table 1, that number maps to number 2. Thus, a range of 128 values can be represented by 5 values with an accompanying quantization error. A quantization map is a table of ranges where a specific value is mapped to the range it falls within.

Within the context of the method for encoding and decoding speech signals according to the present invention, it is preferred to build a quantization table for each parameter variable by utilizing a known k-means quantization algorithm applied to each parameter variable for a large set of sampled data.

In a preferred embodiment of the present invention, a table with five indexes has been created such that an index 1 represents said first parameter variable having quantized values ranging from 2 to 128, index 2 represents said second parameter variable $A_1$ having quantized values $a^{(i)}_1$ ranging vom 0 to 8 index 3 represents said third parameter variable $A_2$ having quantized values $a^{(i)}_2$ ranging vom 0 to 8 index 4 represents said fourth parameter variable $A_3$ having quantized values $a^{(i)}_3$ ranging vom 0 to 8, and index 5 represents said fifth parameter variable $A_5$ having quantized percentage values a (i) 5 ranging vom 0 to 16. However, the method according to the present invention is not confined to these settings.

When utilizing the preferred embodiment of the present invention for analyzing a large amount of human speech, e.g. taken from said TIMIT SPEECH DATABASE, the volume of said curvelet data base converges to an amount of approximately 64,000 distinguishable curvelet type entries. Thus, an alphabet of approximately 64,000 symbols is necessary to encode all those curvelet types. It is, however, preferred to encode the curvelet type simply by an index number to said curvelet data base. Since the maximum value for that index will be about 64,000, an amount that can be represented by 16 bit ("16 bit-quantity") is sufficient to encode each curvelet. During non-silence, the average value of the first parameter variable varies across speakers but ranges between 16 and 32. Thus, compression ratios of from 8:1 to 16:1 are obtained during non-silence. The silence compression ratio is nearly 128:1. Moreover, the curvelet data base can be sub-classified by previous peak amplitude since this is known by the reconstruction algorithm. Hence, a 12-bit quantity can be used for encoding a curvelet instead of a 16-bit quantity.

Further reduction can be obtained if the curvelet database is confined to a single human speaker, to a group of human speakers (e.g. a group of persons sharing one telephone line), or to a class of persons (e.g. female speech vs. male speech). Empirical research has shown that due to similar vocal tract and enunciation characteristics the speech signals produced by one speaker may be more or less similar to that of another speaker. This similarity can be quantified if there exists some basis for measuring the distance between two utterances. Such a basis is usually referred to as a metric or parameter space. Given such a basis, speakers which produce similar speech patterns can be grouped. Speakers within a group will produce only a fraction of all the possible speech patterns produced by all known speakers. Thus, if a speaker can be identified as belonging to such a group, a channel transmitting speech patterns respectively a device storing speech patterns need only have the capacity to transmit the patterns produced by the subgroup. Such a channel respectively such a device would then have bandwidth respectively storage capacity requirements which are related to and dependent upon who is speaking. In fact any one speaker only requires, on average, 8,000 curvelet types to represent anything that might be uttered. Hence, a 13-bit quantity is then sufficient to be used as an index.

Therefore, the present invention is enhanced by providing predefined subsets of the curvelet data base which are specific to individual speakers and which can be activated e.g. by the speaker by entering a personal designating code into the encoder before speech encoding is started. A telephone terminal can be equipped with an interface unit for an IC-card (a small card with an integrated circuit device and a set of electrical connectors thereon), the speaker inserting a personal IC-card storing a code which designates a predetermined subset of the curvelet data base before encoding process starts. The encoder transmits this designating code to the decoder, thus enabling that both encoder and decoder can refer to the same smaller subset of the curvelet data base. However, it is not obligatory to supply the code designating a subset explicitly by an individual speaker. The encoding procedure may be preceded by an estimation procedure, wherein an estimate is made which subset of curvelet types an unknown speaker will utilize. In this case, the encoder notifies the decoder to switch from the overall curvelet data base to a subgroup according to the result of the above-mentioned estimate.

A general method for implementing a speaker dependent channel modifies the number of bits necessary to represent the expected speech patterns based on the identity of the speaker and includes the following steps:

(a) partitioning all parameter values necessary to transmit all speakers into subsets which are representative speaker groups (these subsets must contain fewer elements than the original space ), (b) estimating which subset a given speaker will utilize, (C) encoding and decoding speech data on the basis of the smaller subset.

For example, in a telephone application, such a method might work as follows. Speaker 1 (SPI) calls speaker 2 (SP2). A conversation begins. As SP1 talks, curvelet types representing his speech are selected from the curvelet data base for all possible speakers, and transmitted. As curvelet types are selected and transmitted, a record is kept of what curvelet data base subsets they also belong to. As a result of this record, a subspace is selected to choose the speech curvelet types from (These possible subsets of the curvelet data base are identified beforehand). Then, the decoder is notified to use that subset. At this point, the number of bits used to represent SP1's speech is reduced. If, however, SP1 produced a curvelet belonging to a curvelet type outside of the expected subspace, the decoder is instructed to switch back to the original curvelet database of all possible speech patterns until a new subspace is predicted. An identical approach is used for speaker SP2.

More specifically, sub-dividing the curvelet data base is implemented in a preferred embodiment of the present invention as follows:

(1) Choose a speaker, e.g. from the TIMIT DATABASE at random.

(2) Form a set of all the curvelet types utilized by that speaker.

(3) Form a "speaker group" made of all speakers whose curvelets are at least e.g. 80% the same as those of the original speaker.

(4) Form a new set of all the curvelet types utilized by the entire "speaker group".

(5) Repeat steps 1 through 4 using only the remaining ungrouped speakers.

(6) Repeat step 5 until all speakers are grouped.

The result of this procedure is a number of subsets containing curvelet types. Each of these sets contains curvelet types which are produced by speakers with "similar" vocal characteristics. Further each of these sets contains fewer members than the entire curvelet database.

The estimate which subset of the curvelet data base an unknown speaker will utilize is implemented in a preferred embodiment of the present invention as follows:

(1) Sample and parameterize curvelets from a given speech signal of the unknown speaker.

(2) As each curvelet is parameterized and associated with a curvelet type, track which subgroups the curvelet types belong to.

(3) An unknown speaker is estimated to be utilizing a specific subset of the curvelet data base when a predefined number n of consecutive curvelets belonging to the same subset is identified.

The procedure of choosing the local extreme values used in the method according to the invention is not necessarily the only possible method. Local maxima with various qualifications or restrictions on the "localness" of the extrema may also be used. It is further possible that a left or right hand zero crossing may be used as a marker for the interval instead of the local maxima.

Further compression can be obtained by applying known encoding techniques to said sequence of symbols representing the encoded human speech signal. For example, pairs or whole chains of symbols may be meta-encoded. If indexes are used for representation of symbols, they may be differenced. There exist a variety of possible meta-encoding techniques.

The method according to the present invention can be extended to be adaptive. If a curvelet to be encoded is identified to belong to a curvelet type which is not represented in the curvelet data base, the actual values of the parameter variables are transmitted to the decoder instead of the symbol or index. These curvelets could be stored in the curvelet data base and the quantization space may be updated.

The present invention is described aforehand with regard to encoding and decoding of human speech signals. However, the method according to the invention is not confined to human speech signals. Other acoustical and non-acoustical signals can also be encoded if they exhibit a finite set of sufficiently characteristic signal patterns. An example are acoustic signals of musical instruments.

To be more precise, a cohesive body of signals is necessary and sufficient for using the method according to the invention. A cohesive body of signals is a set of signals produced by similar apparatuses such that the frequency content of the signals falls within a limited or finite range or group of frequency ranges.

I claim:

1. A method for encoding and decoding a human speech signal, comprising the following steps:

(a) generating a curvelet data base storing data related to a finite number of curvelet types of first human speech signals sufficient to cover a plurality of observable human speech signal curvelets;

(a1) a curvelet representing a piece of said first human speech signals on an interval between two subsequent spikes of a spike train corresponding to said speech signals, (a2) said curvelet being described by discrete parameter values for each parameter variable of a predetermined set of one or more parameter variables, (a3) a curvelet type being a class of curvelets described by identical parameter values, (a4) a unique symbol being assigned to each of said curvelet types of said curvelet data base;

(b) encoding a second human speech signal actually to be encoded into a sequence of said symbols;

(b1) said second speech signal being sub-divided into a sequence of curvelets according to the spike train corresponding thereto, (b2) each curvelet of said second speech signal being assigned to said symbol which symbol is assigned to said curvelet type within said curvelet data base to which said curvelet of said second speech signal belongs, (b3) said assigned symbols forming the encoded human speech signal in the order of the curvelets within said second speech signal;

(c) composing a decoded speech signal corresponding to said second human speech signal as a series of chained representative signal curves taken from a set of representative signal curves in the order of the symbols of the encoded second human speech signal, each representative signal curve which is representative for said symbol exhibits a single curvelet being assigned to said symbol; wherein said predetermined set of parameter variables, describing a curvelet between a first local extreme value and a second extreme value of an identical category being adjacent to each other and defining the location of two adjacent spikes of said spike train, comprises the following parameter variables:

a first parameter variable (d) having a value that for each curvelet equals a quantized value indicative of of said curvelet;

a second parameter variable ($A_1$) having a value that for each curvelet equals a quantized value of said first extreme value of said curvelet; a third parameter variable ($A_2$) having a value that for each curvelet equals a quantized value of said second extreme value of the curvelet; a fourth parameter variable ($A_3$) having a value that for each curvelet equals a quantized value of a third local extreme value of said curvelet located between said first local extreme value and said second extreme value and which is of discrete category with regard to said first and second extreme values; a fifth parameter variable ($A_4$) having a value that for each curvelet equals a quantized value of a duration between the occurrence of said first local extreme value and the occurrence of said third local extreme value, expressed as a percent value relative to a duration of said curvelet.

2. A method according to claim 1 wherein said human speech signals are transmitted through a communication channel after being encoded and before being decoded.

3. A method according to claim 1 wherein said human speech signals are stored in information memory means after being encoded and read from said information memory means before being decoded.

4. A method for encoding a human speech signal, comprising the following steps:

(a) generating a curvelet data base storing data related to a finite number of curvelet types of first human-speech signals sufficient to cover a plurality of observable human speech signal curvelets;

(a1) a curvelet representing a piece of said first human speech signals on an interval between two subsequent spikes of a spike train corresponding to said speech signals, (a2) said curvelet being described by discrete parameter values for parameter variables of a predetermined set of one or more parameter variables, (a3) a curvelet type being a class of curvelets described by identical parameter values, (a4) a unique symbol being assigned to each of said curvelet types of said curvelet data base;

(b) encoding a second human speech signal actually to be encoded into a sequence of said symbols;

(b1) said second speech signal being sub-divided into a sequence of curvelets according to the spike train corresponding thereto, (b2) each curvelet of said second speech signal being assigned to said symbol which symbol is assigned to said curvelet type within said curvelet data base to which said curvelet of said second speech signal belongs, (b3) said assigned symbols forming the encoded human speech signal in the order of the curvelets within said second speech signal; wherein said predetermined set of parameter variables, describing a curvelet between a first local extreme value and a second extreme value of the same category being adjacent to each other and defining the location of two adjacent spikes of said spike train, comprises the following parameter variables:

a first parameter variable (d) having a value that for each curvelet equals a quantized value of a duration of said curvelet;

a second parameter variable ($A_1$) having a value that for each curvelet equals a quantized value of said first local extreme value of said curvelet;

a third parameter variable ($A_2$) having a value that for each curvelet equals a quantized value of said second extreme value of the curvelet;

a fourth parameter variable ($A_3$) having a value that for each curvelet equals a quantized value of a third local extreme value of said curvelet located between said first local extreme value and said second extreme value and which is of discrete category with regard to said first and second extreme values;

a fifth parameter variable ($A_4$) having a value that for each curvelet equals a quantized value of a duration between the occurrence of said first local extreme value and the occurrence of said third local extreme value, expressed as a percent value relative to a duration of said curvelet.

5. A method according to claim 4 wherein said human speech signals are transmitted through a communication channel after being encoded and before being decoded.

6. A method according to claim 4 wherein said human speech signals are stored in information memory means after being encoded and read from said information memory means before being decoded.

7. A method for decoding a human speech signal being encoded by a sequence of symbols, each symbol being assigned to a unique curvelet type; a curvelet representing a piece of said decoded human speech signal on an interval of said decoded speech signal, said curvelet being described by discrete parameter values for each of said parameter values for each parameter variable of a predetermined set of one or more parameter variables, a curvelet type being a class of curvelets described by identical parameter values, a unique symbol being assigned to each of said curvelet types; comprising the step of composing said decoded human speech signal corresponding to said encoded human speech signal as a series of chained representative signal curves taken from a set of representative signal curves in the order of the symbols of the encoded second human speech signal, each representative signal curve which is representative for said symbol exhibits a single curvelet being assigned to said symbol; wherein said predetermined set of parameter variables, describing a curvelet between a first local extreme value and a second extreme value of the same category being adjacent to each other and defining the location of two adjacent spikes of said spike train, comprises the following parameter variables:

a first parameter variable (d) having a value that for each curvelet equals a quantized value of a duration of said curvelet;

a second parameter variable ($A_1$) having a value that for each curvelet equals a quantized value of said first local extreme value of said curvelet; a third parameter variable ($A_2$) having a value that for each curvelet equals a quantized value of said second extreme value of the curvelet; a fourth parameter variable ($A_3$) having a value that for each curvelet equals a quantized value of a third local extreme value of said curvelet located between said first local extreme value and said second extreme value and which is of discrete category with regard to said first and second extreme values; a fifth parameter variable ($A_4$) having a value that for each curvelet equals a quantized value of a duration between the occurrence of said first local extreme value and the occurrence of said third local extreme value, expressed as a percent value relative to a duration of said curvelet.

8. A method according to claim 7 wherein said human speech signals are transmitted through a communication channel after being encoded and before being decoded.

9. A method according to claim 7 wherein said human speech signals are stored in information memory means after being encoded and read from said information memory means before being decoded.

10. A method for encoding and decoding a signal taken from a cohesive body of signals, comprising the following steps:

(a) generating a curvelet data base storing data related to a finite number of curvelet types of first signals taken from said cohesive body of signals sufficient to cover a plurality of observable signal curvelets obtainable from said cohesive body of signals;

(a1) a curvelet representing a piece of said first signals on an interval between two subsequent spikes of a spike train corresponding to said signal taken from said cohesive body of signals, (a2) said curvelet being described by discrete parameter values for parameter variables of a predetermined set of one or more parameter variables, (a3) a curvelet type being a class of curvelets described by identical parameter values, (a4) a unique symbol being assigned to each of said curvelet types of said curvelet data base;

(b) encoding a second signal taken from said cohesive body of signals actually to be encoded into a sequence of said symbols;

(b1) said second signal being sub-divided into a sequence of curvelets according to the spike train corresponding thereto, (b2) each curvelet of said second signal being assigned to said symbol which symbol is assigned to said curvelet type within said curvelet data base to which said curvelet of said second signal belongs, (b3) said assigned symbols forming the encoded signal in the order of the curvelets within said second signal;

(c) composing a decoded signal corresponding to said second signal as a series of chained representative signal curves taken from a set of representative signal curves in the order of the symbols of the encoded second signal, each representative signal curve which is representative for said symbol exhibits a single curvelet being assigned to said symbol; wherein said predetermined set of parameter variables, describing a curvelet between a first local extreme value and a second extreme value of the same category being adjacent to each other and defining the location of two adjacent spikes of said spike train, comprises the following parameter variables:

a first parameter variable (d) having a value that for each curvelet equals a quantized value indicative of said curvelet;

a second parameter variable ($A_1$) having a value that for each curvelet equals a quantized value of said first local extreme value of said curvelet;

a third parameter variable ($A_2$) having a value that for each curvelet equals a quantized value of said second extreme value of the curvelet;

a fourth parameter variable ($A_3$) having a value that for each curvelet equals a quantized value of a third local extreme value of said curvelet located between said first local extreme value and said second extreme value and which is of discrete category with regard to said first and second extreme values;

a fifth parameter variable ($A_4$) having a value that for each curvelet equals a quantized value of a duration between the occurrence of said first local extreme value and the occurrence of said third local extreme value, expressed as a percent value relative to a duration of said curvelet.

11. A method according to claim 10 wherein said signals taken from said cohesive body of signals are transmitted through a communication channel after being encoded and before being decoded.

12. A method according to claim 10 wherein said signals taken from said cohesive body of signals are stored in information memory means after being encoded and read from said information memory means before being decoded.

13. A method for encoding a signal taken from a cohesive body of signals, comprising the following steps:

(a) generating a curvelet data base storing data related to a finite number of curvelet types of first signals taken from said cohesive body of signals sufficient to cover substantially all observable signal curvelets obtainable from said cohesive body of signals;

(a1) a curvelet representing a piece of said first signals on an interval between two subsequent spikes of a spike train corresponding to said signals, (a2) said curvelet being described by discrete parameter values for each parameter variable of a predetermined set of one or more parameter variables, (a3) a curvelet type being a class of curvelets described by identical parameter values, (a4) a unique symbol being assigned to each of said curvelet types of said curvelet data base;

(b) encoding a second signal taken from said cohesive body of signals actually to be encoded into a sequence of said symbols;

(b1) said second signal taken from said cohesive body of signals being subdivided into a sequence of curvelets according to the spike train corresponding thereto, (b2) each curvelet of said second signal being assigned to said symbol which itself is assigned to said curvelet type within said curvelet data base to which said curvelet of said second signal belongs, (b3) said assigned symbols forming the encoded signal in the order of the curvelets within said second signal; wherein said predetermined set of parameter variables, describing a curvelet between a first local extreme value and a second extreme value of the same category being adjacent to each other and defining the location of two adjacent spikes of said spike train, comprises the following parameter variables:

a first parameter variable (d) having a value that for each curvelet equals a quantized value of the duration of said curvelet;

a second parameter variable ($A_1$) having a value that for each curvelet equals a quantized value of said first extreme value of said curvelet;

a third parameter variable ($A_2$) having a value that for each curvelet equals a quantized value of said second extreme value of the curvelet;

a fourth parameter variable ($A_3$) having a value that for each curvelet equals a quantized value of a third local extreme value of said curvelet located between said first local extreme value and said second extreme value and which is of opposite category with regard to said first and second extreme values;

a fifth parameter variable ($A_4$) having a value that for each curvelet equals a quantized value of a duration between the occurrence of said first local extreme value and the occurrence of said third local extreme value, expressed as a percent value relative to the duration of said curvelet.

14. A method according to claim 13 wherein said signals taken from said cohesive body of signals are transmitted through a communication channel after being encoded and before being decoded.

15. A method according to claim 13 wherein said signals taken from said cohesive body of signals are stored in information memory means after being encoded and read from said information memory means before being decoded.

16. A method for decoding a signal taken from a cohesive body of signals being encoded by a sequence of symbols, each symbol being assigned to a unique curvelet type; a curvelet representing a piece of said decoded signal on an interval of said decoded signal, said curvelet being described by discrete parameter values for each of said parameter variables values for each parameter variable of a predetermined set of one or more parameter variables, a curvelet type being a class of curvelets described by identical parameter values, a unique symbol being assigned to each of said curvelet types; comprising the step of composing said decoded signal corresponding to said encoded signal as a series of chained representative signal curves taken from a set of representative signal curves in the order of the symbols of the encoded second signal, each representative signal curve which is representative for said symbol exhibits a single curvelet being assigned to said symbol; wherein said predetermined set of parameter variables, describing a curvelet between a first local extreme value and a second extreme value of an identical category being adjacent to each other and defining the location of two adjacent spikes of said spike train, comprises the following parameter variables:

a first parameter variable (d) having a value that for each curvelet equals a quantized value of a duration of said curvelet;

a second parameter variable ($A_1$) having a value that for each curvelet equals a quantized value of said first local extreme value of said curvelet;

a third parameter variable ($A_2$) having a value that for each curvelet equals a quantized value of said second extreme value of the curvelet;

a fourth parameter variable ($A_3$) having a value that for each curvelet equals a quantized value of a third local extreme value of said curvelet located between said first local extreme value and said second extreme value and which is of discrete category with regard to said first and second extreme values;

a fifth parameter variable ($A_4$) having a value that for each curvelet equals a quantized value of a duration between the occurrence of said first local extreme value and the occurrence of said third local extreme value, expressed as a percent value relative to the duration of said curvelet.

17. A method according to claim 16 wherein said signals taken from said cohesive body of signals are transmitted through a communication channel after being encoded and before being decoded.

18. A method according to claim 16 wherein said signals taken from said cohesive body of signals are stored in information memory means after being encoded and read from said information memory means before being decoded.

* * * * *